United States Patent [19]

Staat et al.

[11] Patent Number: 4,827,749

[45] Date of Patent: May 9, 1989

[54] METHODS AND APPARATUS FOR REDUCING SEIZING IN TRANSVERSE ROLLING OF SEAMLESS TUBE BLANKS

[75] Inventors: Karlhans Staat, Ratingen; Hermann Möltner, Grevenbroich, both of Fed. Rep. of Germany

[73] Assignee: Kocks Technik GmbH & Co., Hilden, Fed. Rep. of Germany

[21] Appl. No.: 175,210

[22] Filed: Mar. 30, 1988

Related U.S. Application Data

[63] Continuation of Ser. No. 884,422, Jul. 11, 1986, abandoned.

[30] Foreign Application Priority Data

Jul. 12, 1985 [DE] Fed. Rep. of Germany ..... 3524908
Jun. 5, 1986 [DE] Fed. Rep. of Germany ..... 3618949

[51] Int. Cl.[4] ..... B21B 19/06
[52] U.S. Cl. ..... 72/96
[58] Field of Search ..... 72/19, 96, 97

[56] References Cited

U.S. PATENT DOCUMENTS 2,006,336 5/1935 Diescher ..... 80/13
2,480,381 8/1949 Offutt ..... 80/13
2,780,119 2/1957 Holmquist .
3,566,653 3/1971 Unrath .

FOREIGN PATENT DOCUMENTS 682334 10/1939 Fed. Rep. of Germany .
590024 1/1978 U.S.S.R. .

*Primary Examiner*—Lowell A. Larson
*Attorney, Agent, or Firm*—Buchanan Ingersoll; Paul A. Beck

[57] ABSTRACT

A method and apparatus for transverse, preferably skew, rolling seamless tube blanks, is provided wherein said seamless tube blanks are rolled down by a mandrel rod lying in their longitudinal bore or are rolled onto a mandrel rod at the delivery end. During transverse rolling each tube blank is subjected to a predetermined, controllable torque exerted by the mandrel rod in order to eliminate substantially the formation of pockets in the region of the sizing pass during transverse rolling.

5 Claims, 3 Drawing Sheets

METHODS AND APPARATUS FOR REDUCING SEIZING IN TRANSVERSE ROLLING OF SEAMLESS TUBE BLANKS

This application is a continuation of my copending application Ser. No. 884,422 filed July 11, 1986, now abandoned.

This invention relates to methods and apparatus for the transverse rolling of seamless tube blanks, in which a seamless tube blank is rolled down over a mandrel rod lying in its longitudinal bore or is rolled onto a mandrel rod at the delivery end. This type of transverse rolling is used, for example, in generally known rolling lines, such as skew rolling mills, Assel rolling mills, Diescher rolling mills, Transvel rolling mills and conical skew rolling mills, etc.

In this type of rolling method, a mandrel rod is either inserted into the longitudinal bore of a hollow block or it is already located therein following a previous piercing process. The hollow block and the mandrel rod are together pushed in the axial direction into the sizing pass formed by the rolls, discs and guides, following which the trailing end portion of the mandrel rod is held back in the axial direction, the hollow block is shaped into a tube blank and, at the same time, is rolled down over the mandrel rod through the sizing pass.

In a known method of this type (U.S. Pat. No. 2,006,336), the mandrel rod and the hollow block into which it has been inserted are rotated about their common longitudinal axis by a motor which is coupled to the mandrel rod by a clutch connected to the trailing end portion of the mandrel rod remote from the rolls. This is intended to reduce the acceleration which occurs when a non-rotating hollow block containing a mandrel rod within it is inserted into the sizing pass and is engaged by the driven rolls. During transverse rolling, the work material and the mandrel rod rotate and the above-mentioned acceleration from the standstill can be forcible enough to cause considerable rolling errors. However, once the rolls have engaged the hollow block, it rotates at the speed determined by the rolls. In this known method, this is ensured by an over running clutch between the mandrel rod and the motor which can be switched off during actual transverse rolling. Even if it continues to run at its operating speed, this speed is less than the rotational speed of the mandrel rod or hollow block, so that both are driven by the rolls and not by the motor.

This method and other corresponding known methods for transverse rolling seamless tube blanks have the disadvantage of so-called pocket formation. Viewed in the cross section, the work material is rolled between the working surfaces of the rolls and the outer surface of the mandrel rod, thus reducing the wall thickness of the work material. In doing so, the mandrel rod acts as a counter roll to the driven rolls. As it is not driven in the known methods, it must be driven by the driven rolls by way of the work material, so that torque is transmitted from the driven rolls by way of the work material to the mandrel rod, which is comparable to a friction-driven roll. The rolling work to be carried out by the mandrel rod is thus introduced by way of the work material. As a result, the point of no-slip moves in the periphery direction of the work material and a pocket-like separation of the inner surface of the work material from the outer surface of the mandrel rod results. At the same time, the work material presses into the roll gap. In the case of work material with narrow wall thicknesses relative to the diameter and when rolling large reductions of cross sectional area, this phenomenon is particularly marked. Futhermore, it also occurs primarily in the region of the trailing end portion of the work material, because, when the rolling process is at an advanced stage, there is no longer any support from the rear portion of the hollow block as it has not yet been rolled and thus still has very thick walls. The conditions of passage through the sizing path are thus no longer guaranteed. The work material also often penetrates so far into the roll gap, that is into the free space between adjacent rolls or between the rolls and any guides provided, that it gets stuck.

It was attempted to overcome this problem (USSR Patent Specification No. 590,024) in that the trailing ends of the tube blanks are rolled out with larger wall thicknesses by separating the rolls or by retracting the mandrel rod. This method has the essential disadvantage that the thick-walled end portions either have to be separated and scrapped, or additionally subsequently stretch-reduced. Both these alternatives have considerable economic disadvantages and disrupt the manufacturing process as a whole.

It is an object of the invention to avoid to the largest possible extent the formation of pockets inside the sizing pass.

The present invention resides in a method of transverse rolling seamless tube blanks in which a seamless tube blank is rolled down over a mandrel rod lying in its longitudinal bore or is rolled onto a mandrel rod at the delivery end and in which the tube blanks are subjected to a predetermined, controllable torque exerted by the mandrel rods during transverse rolling.

This torque can be produced by means of a known mandrel rod drive. Thus, the problem of the prior art methods and structures is solved according to the present invention in that the tube blanks are acted upon during transverse rolling by a prescribed adjustable torque exerted by the mandrel rod. This torque can be accomplished with the aid of a familiar mandrel rod drive. In contrast to the familiar construction, however, it is necessary for carrying out the process according to the invention to omit the slip coupling between the mandrel rod and its drive and to regulate the drive so that the torque that suppresses bag formation results. With the aid of this torque the mandrel rod operates as a normal driven roll and it is possible to displace the no-slip point of the rolled goods by appropriate regulation of the mandrel rod drive so that pouch formation is maximally suppressed. It can at least be eliminated to the extent that a seizing of the rolled goods no longer need be feared. The wall thickness of the rolled goods can be maintained over the entire length and thinner walls than before are attained.

In another embodiment of the process according to the invention the tube blanks can be acted upon during transverse rolling in the region of various longitudinal sections with mandrel rod torques of varying magnitude. The fact that support by the not yet rolled and thus thick-walled hollow ingot section during the rolling of the rear tube blank end section can be compensated, for example, in this manner.

It has proven advantageous if the torque exerted by the mandrel rod is regulated as a function of an outside diameter measurement on the emerging tube blank. Fluctuations in the torque applied to the mandrel rod may be identified as follows. If the outside diameter varies beyond an admissible tolerance, the torque exerted by the mandrel rod can also be modified with the aid of a regulation means such as a regulating circuit, that is, so that pocket formation again returns to the normal degree and the outside diameter of the tube blank again lies in the desired range. It is also possible to regulate the torque exerted by the mandrel rod to a constant value as a function of a torque measurement on the mandrel rod. In this case, the identification means for determining fluctuations in the torque applied by the mandrel rod may be any suitable torque measuring instrument. Fluctuations in the torque exerted can result, for example, due to the fact that changes occur in the coefficient of friction between mandrel rod and tube blank as a result of locally variable lubrication of the mandrel rod, which can be compensated in this manner.

The invention includes a rolling mill for the transverse rolling of seamless tube blanks comprising a plurality of transverse rolls disposed about the pass lines, a mandrel or mandrel rod extending through or up to the pass defined by the rolls, at least one motor and a non-overrunning transmission between the motor and the mandrel or mandrel rod for rotating the mandrel or mandrel rod whereby the mandrel or mandrel rod exerts a torque in the tube blanks during rolling. A torque exerted by the mandrel rod is regulated as a function of the outside diameter measurement on the emerging tube blank in some cases. In other cases, the torque exerted by the mandrel rod is regulated to a constant value as a function of the torque measurement on the mandrel rod.

In the foregoing general description of our invention we have set out certain objects, purposes and advantages of our invention. Other objects, purposes and advantages of this invention will become apparent from a consideration of the following description and the accompanying drawings in which.

Figure 1:
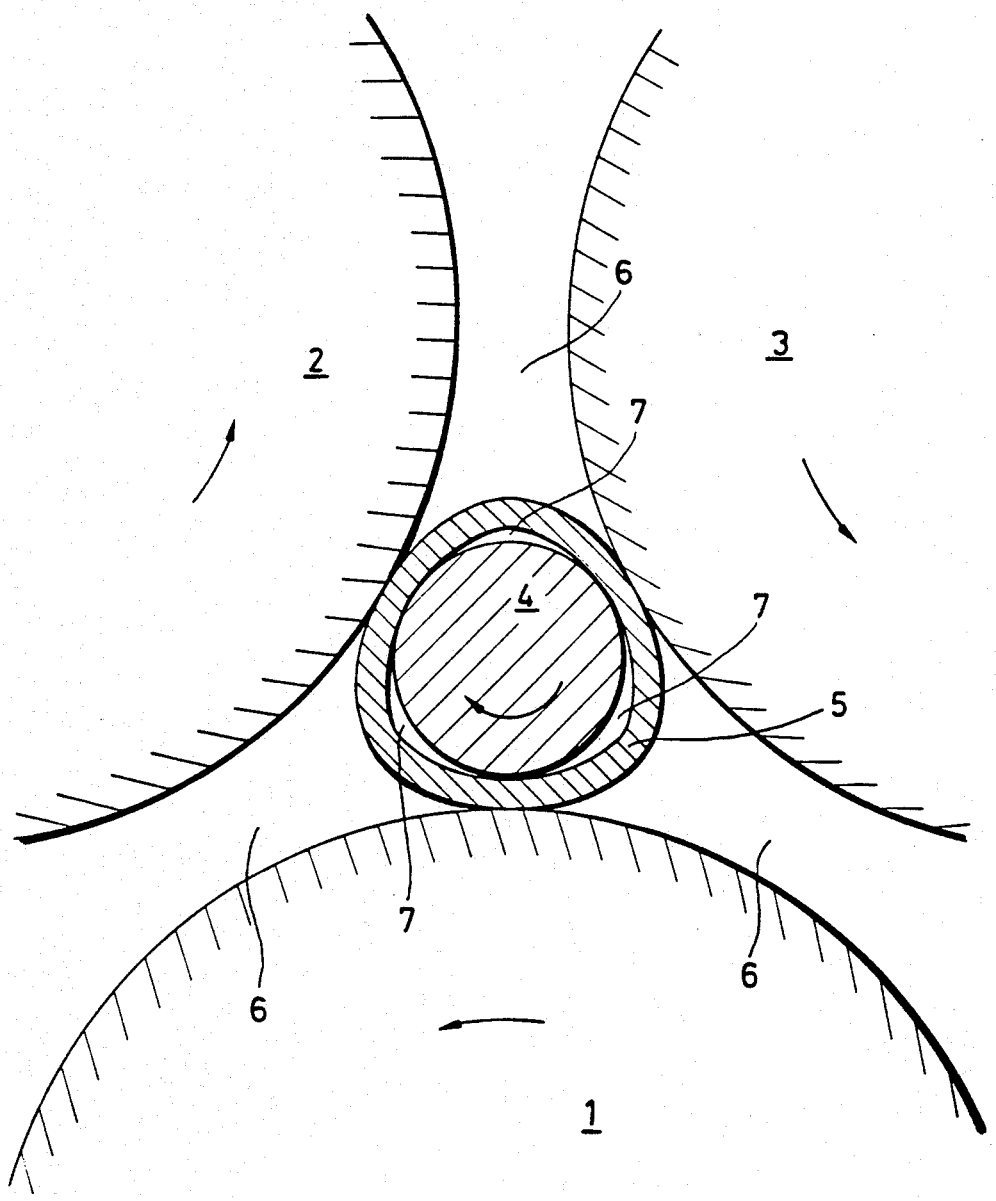
FIG. 1 shows a pass opening of a three-roll slant roll train in cross section.

Three rolls, 1, 2 and 3, that surround a mandrel rod 4 are depicted partially and in cross section in FIG. 1. Because the mandrel rod 4 is shoved into a hollow ingot that is to be rolled into a tube blank, the rolled goods 5 is located between the mandrel rod 4 and the rolls 1–3. It is clearly evident that the rolled goods 5 becomes detached from the surface of the mandrel rod 4 in the region of the roll gap designated by 6 and forms a bag or pouch or pockets 7. The latter is, however, depicted especially large in FIG. 1 in order to demonstrate what is meant by the said pocket formation. With the aid of this invention, this pocket formation can be almost completely eliminated or at least sharply restricted.

Figure 2:
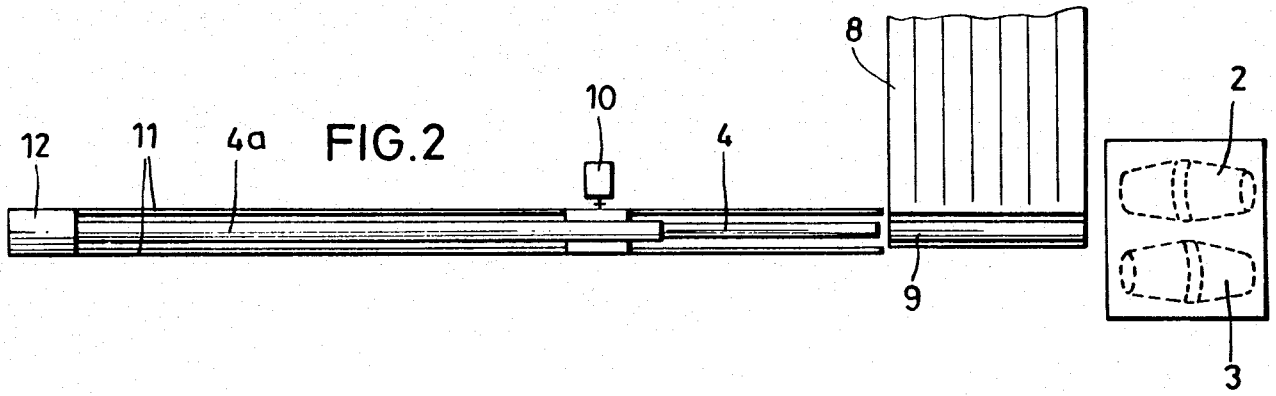
FIG. 2 shows a slant roll train with driven mandrel rod in front of the roll in plan view.
Figure 3:
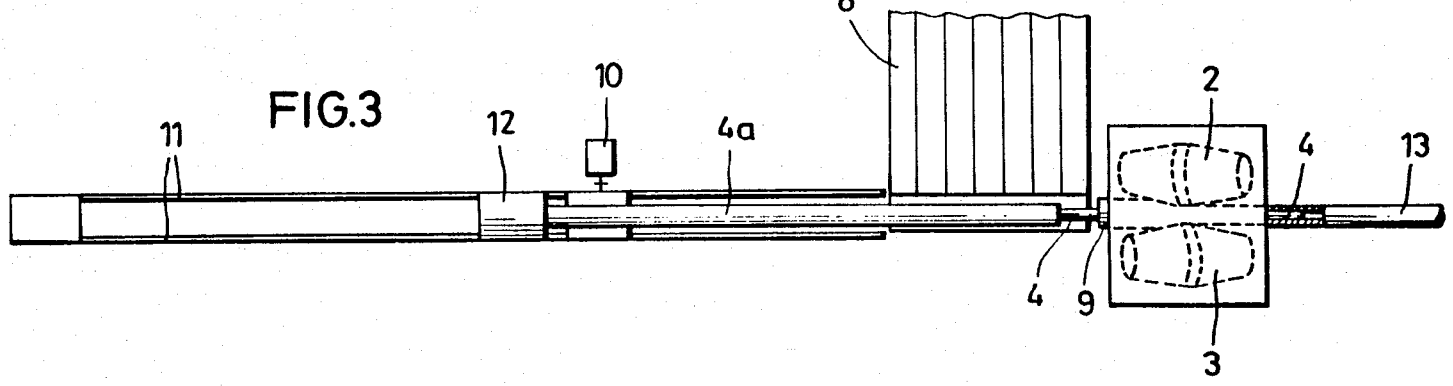
FIG. 3 shows a slant roll train with driven mandrel rod during rolling in plan view.

The rolls 2 and 3 are detectable in FIG. 2, but the underlying roll 1 is not visible. The known roll drive has also been omitted. A hollow ingot 9 arrives over a transverse means of transport 8 into the rolling axis in front of the withdrawn mandrel rod 4. The mandrel rod 4 and the elongating coupled shaft rod **4*a* can be moved in the axial direction with the aid of a motor 10 inside of a guide 11, that is, together with a mandrel rod support 12, in which a rotating drive for the shaft rod 4*a* and thus for the mandrel rod 4 is integrated. The roll train according to FIG. 2 is shown in FIG. 3, but with the mandrel rod 4 and/or the shaft rod 4*a* shoved forward. The hollow ingot 9 is already essentially rolled, such that a tube blank 13 projects from the roll stand on the outlet side. The mandrel rod 4 also projects somewhat from the roll stand on the exit or delivery side. The mandrel rod is held in this position and after completion of the rolling process is withdrawn into the position shown in FIG. 2**.

Figure 4:
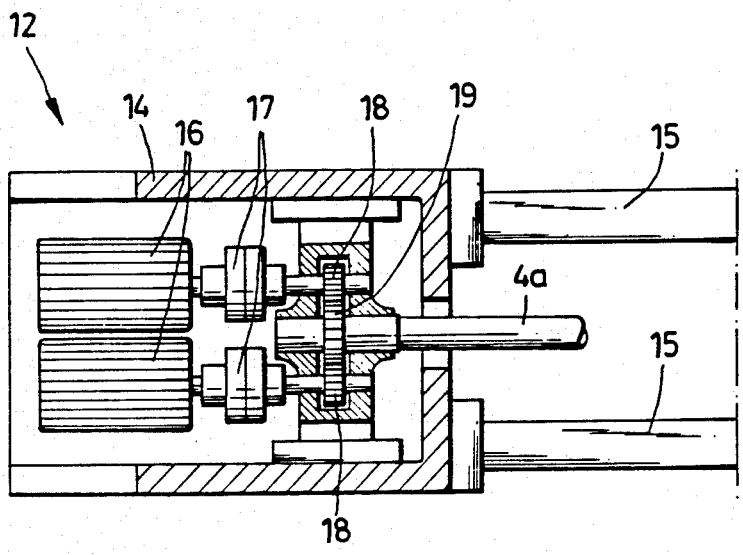
FIGS. 4 to 6 show the mandrel rod drive in plan view, front view and side view in partial cross section.
Figure 5:
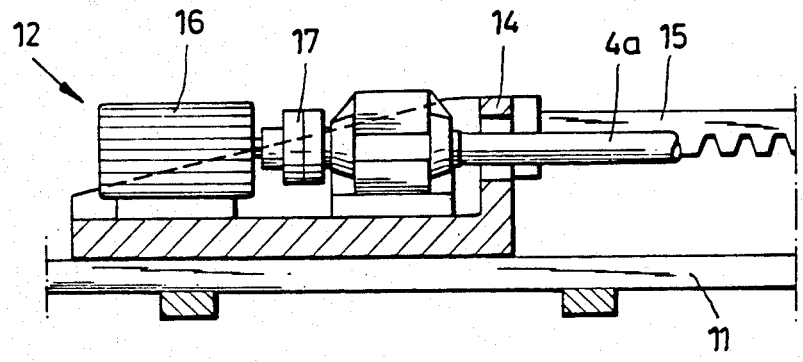
Figure 6:
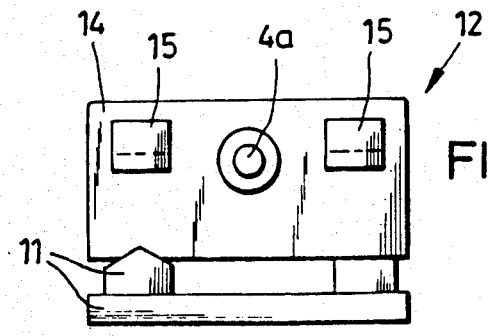

The support 12 with the integrated rotating drive is shown in FIGS. 4–6. The housing 14 of the support 12 is driven in an axially displaceable manner on the guides 11 by means of toothed racks 15 that are driven by the motor 10 (FIGS. 2 and 3) by means of pinions (not shown). The shaft rod **4*a* that constitutes an extension of the mandrel rod 4 is fixedly, but rotatably supported in the axial direction in the housing 14 of the support 12. Two motors 16, preferably hydraulically driven, act through a rotation proof (direct drive) coupling 17 on two pinions 18, which jointly drive a gear 19 whose rotary movement is transferred directly through the shaft rod 4*a* to the mandrel rod 4**.

The hollow ingot portion which is yet tube rolled and therefore still has thick walls provides some support for the work material being rolled and this reduced the size of the pockets 7. Thus, the exertion of torque by the mandrel or mandrel rod becomes more important towards the trailing end of the tubular material when the support from material still to be rolled is no longer present. Thus, it may be advantageous for the torque exerted by the mandrel or mandrel rod to be varied during the rolling operation.

In the foregoing specification we have set out certain preferred practices and embodiments of our invention, however, it will be understood that this invention may be otherwise embodied within the scope of the following claims.

We claim:

1. A method for reducing seizing caused by enlarged pocket formation in transverse rolling of seamless tube blanks comprising the steps of:

(a) rolling a seamless tube blank between transverse rolls over a mandrel rod lying in a longitudinal bore thereof or rolling said blank between transverse rolls onto a mandrel rod at a delivery end thereof;

(b) applying a predetermined, controllable torque to the tube blank during transverse rolling with said mandrel rod;

(c) identifying any fluctuations in the predetermined torque applied to the tube blank by the mandrel rod; and (d) regulating the amount of torque applied by said mandrel rod to compensate for such fluctuations so that pocket formation may be reduced and maintained to a normal degree whereby reducing seizing of the tube blank between said tranverse rolls.

2. A method as claimed in claim 1, in which different longitudinal portions of the tube blank is subjected to differing mandrel rod torques during transverse rolling.

3. Process according to claims 1 or 2, wherein said fluctuations are identified by taking outside diameter measurements of said tube blank as it emerges from said rolls and the torque exerted by the mandrel rod is regulated as a function of the outside diameter measurement on the emerging tube blank.

4. Process according to claim 1, wherein said fluctuations are identified by taking torque measurements of the mandrel rod and the torque exerted by the mandrel rod is regulated to a constant value as a function of a torque measurement on the mandrel rod.

5. A method as claimed in claims 1 or 2, in which the tube blank is subjected to skew rolling.

* * * * *